US006196750B1

(12) United States Patent
Hansen

(10) Patent No.: US 6,196,750 B1
(45) **Date of Patent: *Mar. 6, 2001**

(54) POCKET, ESPECIALLY FOR USE WITH LOOSE-LEAF RING BINDERS

(75) Inventor: Ole Hansen, Vallensbæk Strand (DK)

(73) Assignee: S.S.C. A/S, Albertslund (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/194,544

(22) PCT Filed: Mar. 25, 1997

(86) PCT No.: PCT/DK97/00130

§ 371 Date: Nov. 30, 1998

§ 102(e) Date: Nov. 30, 1998

(87) PCT Pub. No.: WO98/08692

PCT Pub. Date: Mar. 5, 1998

(30) Foreign Application Priority Data

Aug. 30, 1996 (DK) ..... 0920/96

(51) Int. Cl.[7] ..... B42F 3/00; B42F 3/06; B65D 27/00; A47G 1/06; G09F 1/12

(52) U.S. Cl. ..... 402/79; 281/2; 281/38; 283/61

(58) Field of Search ..... 281/2, 38; 283/61; 402/79

(56) References Cited

U.S. PATENT DOCUMENTS

| | | | |
|---|---|---|---|
| 717,957 | 1/1903 | Weaver . | |
| 818,130 | 4/1906 | Swan . | |
| 915,789 | 3/1909 | McComb . | |
| 920,072 | 4/1909 | Maltby . | |
| 1,107,351 | 8/1914 | Proudfit . | |
| 1,222,881 | 4/1917 | McCullough . | |
| 1,371,459 | 3/1921 | Amlie . | |
| 3,107,673 | 10/1963 | Haddad . | |
| 4,193,704 * | 3/1980 | Miller et al. | 402/19 |
| 4,430,015 | 2/1984 | Nerlinger . | |
| 4,479,733 * | 10/1984 | Segal | 402/79 |
| 4,551,039 | 11/1985 | Basseches . | |
| 4,595,309 | 6/1986 | Chinchar . | |
| 5,335,027 * | 8/1994 | Lin et al. | 40/159 |
| 5,433,546 | 7/1995 | Kershaw . | |

FOREIGN PATENT DOCUMENTS

| | | |
|---|---|---|
| 26 41 098 A1 | 3/1978 | (DE) . |
| 34 13 045 C2 | 5/1986 | (DE) . |
| 34 13045 C2 | 5/1986 | (DE) . |
| 38 13 578 C1 | 11/1989 | (DE) . |
| 0 606 958 A1 | 1/1994 | (EP) . |
| 1 280156 | 7/1969 | (GB) . |
| 2 247 433 | 3/1992 | (GB) . |
| WO 81/02410 | 9/1981 | (WO) . |

* cited by examiner

*Primary Examiner*—A. L. Wellington
*Assistant Examiner*—Mark T. Henderson
(74) *Attorney, Agent, or Firm*—Larson & Taylor, PLC

(57) ABSTRACT

In a pocket of flexible sheet material comprising: a) a plurality of holes placed adjacent at least one edge of said pocket and adapted for releasable engagement with means capable of penetrating said holes, the main novel feature is b) that for each hole, a slit extends from said edge into the hole, each slit being rectilinear and opening tangentially into the hole concerned at the part of said hole lying most distant from said edge, the region adjacent said edge and in which said holes are formed being reinforced. With this arrangement, the pocket can be inserted into and removed from a loose-leaf ring binder without opening the rings by carrying out a simple procedure, at the same time ensuring that the pocket will not be pulled out inadvertingly, such as by weight of heavy documents in the pocket. It is also possible to use the pocket in a ring binder in which the rings are not adapted to be opened.

16 Claims, 1 Drawing Sheet

POCKET, ESPECIALLY FOR USE WITH LOOSE-LEAF RING BINDERS

TECHNICAL FIELD

The present invention relates to a pocket, especially for use with loose-leaf ring binders, said pocket being of the kind comprising a) a plurality of holes placed adjacent at least one edge of said pocket and adapted for releasable engagement with means capable of penetrating said holes.

BACKGROUND ART

Document DE-A1-2,641,098 discloses a pocket for use in storing photographs in a specially designed holder. According to this document, one edge region of the pocket 2 is a reinforcing strip 10 provided with holes 11 and 12, to which slits 13 and 14, respectively, extend from the outer edge of said strip 10. These slits make it possible to bring a holding member 5, preferably a rubber cord, into and out of engagement with said holes 11 and 12. These holes are not, however, used to support the pockets 2 in the holder 1, this function being fulfilled by slits 4 in the strip 10 co-operating with a projection 3 on the holder 1.

It will be realized that the pocket 2 disclosed in the above document is not suitable for use in loose-leaf ring binders, especially when there is a need for both i) retaining the pocket, even when heavily loaded with documents, in the binder without a risk of it coming loose inadvertently, and ii) removing and inserting the pocket without having to open the rings in the binder.

DISCLOSURE OF THE INVENTION

It is the object of the present invention to provide a pocket of the kind referred to initially, with which it is possible by means of simple constructional features to achieve the effects described in items i) and ii) above, and this object is achieved by means of the following new feature:

b) that for each hole a slit extends from said edge into the hole, each slit opens tangentially into the hole concerned at the part of said hole lying most distant from said edge, the region adjacent said edge and in which said holes are formed being reinforced.

The combination of slits and holes is known from document U.S. Pat. No. 4,193,704, vide esp. FIG. 8, but not in connection with pockets of the kind, with which the present invention is concerned. Thus, this document mainly concerns the releasable attachment of sheets in a so-called wire binder using a helically wound wire as the "back". Acording to this document, the slits form an angle with the edge of approx. 80 degrees, so that the "hook effect" provided by the—apparently un-reinforced—region bounded by each hole, its associated slit and the edge is limited.

The use of a reinforced edge region does, however, ensure that this "hook effect" is sufficient to achieve the effect described in item i) above, without compromising the effect described in item ii).

Advantageous embodiments of the pocket according to the invention, the effects of which—beyond what is obvious—are explained in the following detailed part of the present description, are set forth in claims 2–11.

BRIEF DESCRIPTION OF THE DRAWINGS

In the following detailed part of the present description, the invention will be explained in more detail with reference to the exemplary embodiment of a flexible, transparent pocket according to the invention shown in the drawings, in which.

DESCRIPTION OF THE PREFERRED EMBODIMENT

Figure 1:
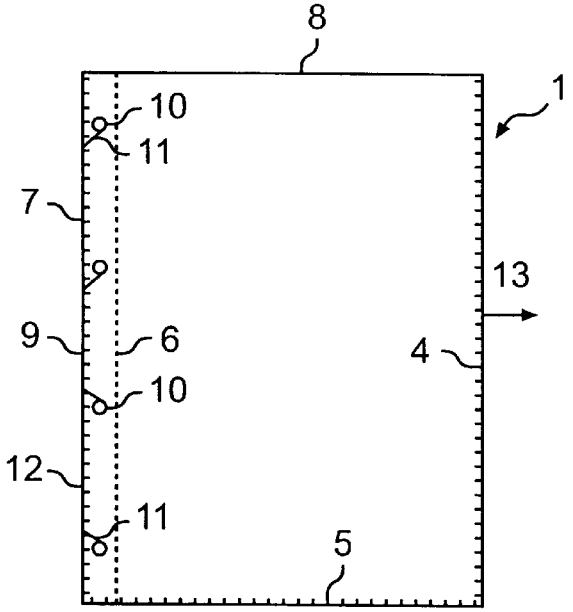
FIG. 1 shows a pocket as viewed against a major face, FIG. 2 at a greatly enlarged scale shows the region about one of the engagement holes in the pocket of FIG. 1, FIG. 3 at twice of the scale of FIG. 2 is a sectional view taken along the line III—III in FIG. 2.
Figure 2:
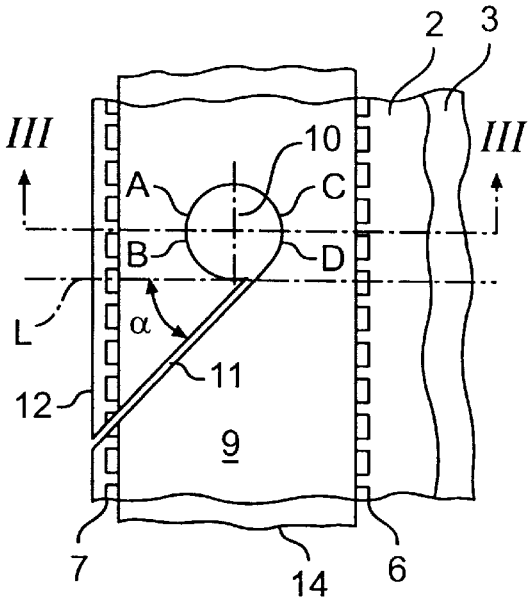
Figure 3:
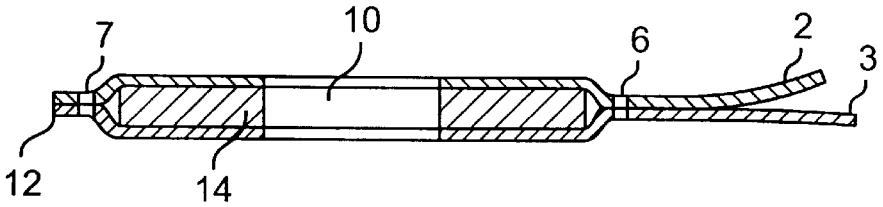

The flexible, transparent plastic pocket 1 shown in FIG. 1 consists in a manner known per se, cf. also FIGS. 2 and 3, of a front sheet 2 and a back sheet 3, welded together by means of seams 4–7, i.e. a right-hand seam 4, a bottom seam 5, a left-hand seam 6, and an edge seam 7. In this manner a pocket or bag is formed, being accessible through the opening between the sheets 2 and 3 at the upper edge 8.

Figure 4:
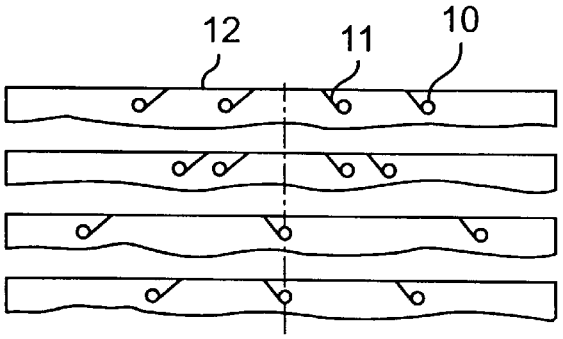
FIG. 4 shows various examples of possible arrangements of holes with associated slits in pockets according to the invention.

The left-hand edge region 9 is penetrated by a number of holes 10, spaced so as to fit the rings in the ring binder (not shown), with which the pocket 1 is to be used. As shown in FIG. 4, various spacing arrangements may be used, including also embodiments (not shown) constituting combinations of the arrangements shown in FIG. 4, or any other suitable arrangement.

As far as the above description of the exemplary embodiment shown in the drawing is concerned, this description applies equally well to flexible transparent pockets available on the market at the time the present invention was made.

As may be seen on FIGS. 1 and 2, the edge region 9 comprises a number of oblique slits 11, each extending from the left-hand edge 12 and through the edge seam 7 and a major part of the edge region 9, opening tangentially into the part of the respective hole 10 lying most distant from the left-hand edge 12. Considering this point further, as shown in FIG. 2, hole 10, in common with any circle or similar geometrical shape, can be divided into four quadrants, indicated as A, B, C and D. Quadrants A and B are near quadrants, i.e., are relatively close to edge 12 as compared with quadrants C and D, while quadrants C and D are remote quadrants, i.e., are further away from edge 12 than near quadrants A and B. As shown in FIG. 2, slit 11 opens tangentially into the associated hole 10 at a quadrant D of hole 10 defined relative to the edge 12 which is remote from edge 12. It will be appreciated that other slits 11 will, as shown in FIG. 3, intersect the respective hole 10 from the opposite side of that shown in FIG. 2, i.e., will open tangentially into the associated hole 10 at the quadrant C which is also remote from edge 12.

As will be seen from FIG. 2, the oblique slit 11 makes an angle $\alpha$ with a line L at right angles to the left-hand edge 12.

Looking at FIG. 2, it may be seen that the region bounded by the section line III—III, the hole 10, the slit 11 and the left-hand edge 12 constitute a hook-member, the function of which in the "normal" state, when the pocket 1 rests in engagement with the rings in the ring binder (not shown), is to hold the pocket 1 against being pulled away from said rings. Considering the fact that the pocket 1 is made from quite thin flexible plastic material, it will be realized that the force, with which said hook region can withstand a pulling force exerted on the pocket 1 in the right-hand direction as shown by the arrow 13 is necessarily limited.

On the other hand, said force, with which the hook region resists said pulling, is not negligible.

The finite, but limited holding capability of the hook region referred to above is utilized by the invention to achieve the following two effects:

i. to maintain the engagement between the ring binder (not shown) and the pocket 1, even when a not inconsiderable force is exerted on the pocket 1 in the direction 13, and ii. to make it possible to disengage the pocket 1 from the ring binder using a simple procedure and exerting only a small force.

The effect mentioned in item i above is achieved by the cooperation between the hook regions adjacent all the holes 10 and slits 11, as the force exerted along the direction 13 will be more or less evenly distributed among the hook regions. The effect described in item ii above is, on the other hand, achieved simply by gripping the pocket 1 close to the left-hand edge region 9 at either end and pulling in a direction at right angles to the large surfaces of the pocket 1, i.e. towards the viewer in FIG. 1. When proceeding in this manner, the hook regions will, in turn, flex under the influence of the rings in the ring binder, enabling the rings to slide out through the slits 11.

To give the hook regions bounded by the line III—III, the hole 10, the slit 11 and the edge 12 the requisite strength to fulfil the function mentioned in item i above, it is preferred to provide the left-hand edge region 9 with a reinforcement strip 14, in the exemplary embodiment shown trapped between the two seams 6 and 7. Obviously, both the holes 10 and the slits 11 extend right through this reinforcement strip 14.

In an embodiment having been tried out in practice, the front and back sheets 2 and 3, respectively, were made of polypropylene film with a thickness of approximately 35 $\mu$m, while the thickness of the reinforcement strip 14 was approximately 220 $\mu$m. Other dimensions may, of course, be used, such as for the front and back sheets 10–300 $\mu$m, preferably 25–60 $\mu$m, most preferably 30–40 $\mu$m. The thickness of the reinforcement strip 14 may be between 60 and 300 $\mu$m; a thickness of 175 $\mu$m has been tried with success.

These dimensions refer to the case, in which the pocket 1 is adapted to accommodate documents in the international format A4. This means, of course, that the dimensions and positions of the left-hand edge region 9 as well as the holes 10 will be substantially the same as in conventional pockets for the same format.

Referring to FIG. 2: The angle $\alpha$ shown in this Figure will obviously influence the properties of the hook region. Thus, if this angle $\alpha$ were considerably smaller, the tip of the hook region lying closest to the edge 12 would be relatively stiff and make it difficult to bring the pocket 1 into engagement with the rings on the ring binder without opening the rings. On the other hand, if the angle $\alpha$ were too great, the tip of the hook region would be "floppy", which would also make it difficult to bring the pocket 1 into engagement with the rings.

According to the present invention, the preferred interval for the angle $\alpha$ is between 39 and 47°, whereas an angle $\alpha$ of approximately 43° is preferred, so as to make a suitable compromise between the two tendencies referred to above.

As will be seen from FIGS. 1 and 4, the slits 11 are arranged in such a manner, that some of them extend from the holes 10 to the edge 12 in one direction, whereas some of them extend in the opposite direction. It lies within the scope of the invention to have all slits 11 extend in the same direction, but the arrangement shown in the drawing is preferred, i.e. with the upper slits extending downwardly from the hole 10 to the edge 12, and the lower slits extending upwardly (the expressions "up" and "down" are, of course, connected to the situation, in which the bottom seam 5 is lowermost and the upper edge 8 is uppermost).

It is possible in a manner not shown to increase the rigidity of the hook region bounded by the line III—III, the hole 10, the slit 11 and the edge 12 in various ways. Thus, if a reinforcement strip 14 is not used and the front and back sheets 2 and 3, respectively, lie in close abutment throughout the left-hand edge region 9, the edges of the front and back sheets 2 and 3, respectively, on one or both sides of the slit 11 could be joined by a welding seam, e.g. similar to the seams 6 and 7. Another possibility could be to make the two sheets adhere to each other throughout the hook regions or even throughout the whole of the edge region 9, using some suitable method of adhesion or welding. If a reinforcement strip 14 is used, similar measures could be taken, the only difference being that the reinforcement strip 14 is included.

The pocket 1 shown in FIG. 1 is of the commonly used "bag" type, access to the space between the front and back sheets 2 and 3, respectively, being only via the open upper end at the upper edge 8. It does, however, lie within the scope of the invention to use other arrangements. Thus, one possibility is, in a well-known manner, to cut the front sheet 2 free close to the seam 6, so that its upper left-hand part can be flexed away from the back sheet 3 to make it easier to insert and remove document. Another possibility is to affix a number, say 4, smaller pockets approximately of format A6 to the back sheet 3, creating a facility for storing e.g. photographs.

In the above description, one example of a material that can be used for making the pocket 1 has been mentioned. It is, however, possible within the scope of the present invention to use any material available now or in the future, that can be used to make pockets having the functional characteristics described above.

LIST OF PARTS

L line
$\alpha$ angle
1 pocket
2 front sheet
3 back sheet
4 right-hand seam
5 botton seam
6 left-hand seam
7 edge seam
8 upper edge
9 (left-hand) edge region
10 hole
11 oblique slit
12 left-hand edge
13 arrow
14 reinforcement ship

What is claimed is:

1. A pocket of flexible sheet material comprising:

a plurality of holes placed adjacent at least one edge of said pocket and adapted for releasable engagement with loose-leaf ring binders, a region located adjacent said edge and in which said holes are formed being reinforced, said holes being adapted for carrying the pocket and each said hole having an associated slit which extends from said edge into the hole, each slit opening tangentially into the associated hole at a quadrant of said associated hole defined relative to the edge which is remote from said edge and each slit forming an angle with a line at right angles to said edge having a value between 39° and 47°.

2. A pocket according to claim 1, wherein some of the slits extend from said edge into said holes in an opposite direction to that of other of said slits.

3. A pocket according to claim 1, wherein said pocket comprises two sheets of flexible sheet material joined at at least two edges.

4. A pocket according to claim 1, wherein said sheets are made from plastic material, such as polyethylene, polypropylene or a material having similar properties, having a thickness between 10 and 300 $\mu$m.

5. A pocket according to claim 1, wherein said pocket is at least partly made from transparent material.

6. A pocket according to claim 2, wherein slits situated between a first end of said edge and a region near a mid-point of said edge extend in a first direction from said edge to said holes, and slits situated between a second opposite end of said edge and said region near the mid-point of said edge extend in a second direction, opposite to said first direction, from said edge to said holes.

7. A pocket of flexible sheet material comprising:

a plurality of holes placed adjacent at least one edge of said pocket and adapted for releasable engagement with loose-leaf ring binders, a region located adjacent said edge and in which said holes are formed being reinforced, said holes being adapted for carrying the pocket and each said hole having an associated slit which extends from said edge into the hole, each slit opening tangentially into the associated hole at a quadrant of said associated hole defined relative to the edge which is remote from said edge, each slit being rectilinear and forming an angle with a line at right angles to said edge having value between 39 and 47°.

8. A pocket according to claim 7, wherein said angle is approximately 43°.

9. A pocket of flexible sheet material comprising:

a plurality of holes placed adjacent at least one edge of said pocket and adapted for releasable engagement with loose-leaf ring binders, a region located adjacent said edge and in which said holes are formed being reinforced, said holes being adapted for carrying the pocket and each said hole having an associated slit which extends from said edge into the hole, each slit opening tangentially into the associated hole at a quadrant of said associated hole defined relative to the edge which is remote from said edge and each slit forming an angle with a line at right angles to said edge having a value between 39° and 47°, said region being reinforced by means of an additional strip of sheet material.

10. A pocket according to claim 9, wherein said pocket and said additional reinforcing strip are made from plastic material, the plastic material of the strip being of the same kind as that of the pocket is made, and having a thickness between 60 and 300 $\mu$m.

11. A pocket of flexible sheet material comprising:

a plurality of holes placed adjacent at least one edge of said pocket and adapted for releasable engagement with loose-leaf ring binders, a region located adjacent said edge and in which said holes are formed being reinforced, said holes being adapted for carrying the pocket and each said hole having an associated slit which extends from said edge into the hole, each slit opening tangentially into the associated hole at a quadrant of said associated hole defined relative to the edge which is remote from said edge and each slit forming an angle with a line at right angles to said edge having a value between 39° and 47°, and said sheets being made from polypropylene having a thickness between 10 and 300 $\mu$m.

12. A pocket of flexible sheet material comprising:

a plurality of holes placed adjacent at least one edge of said pocket and adapted for releasable engagement with loose-leaf ring binders, a region located adjacent said edge and in which said holes are formed being reinforced, said holes being adapted for carrying the pocket and each said hole having an associated slit which extends from said edge into the hole, each slit opening tangentially into the associated hole at a quadrant of said associated hole defined relative to the edge which is remote from said edge and each slit forming an angle with a line at right angles to said edge having a value between 39° and 47°, parts of the sheet material adjacent to, and on at least one side of the slits, being joined to each other, in a manner to impart increased rigidity to said parts.

13. A pocket according to claim 12, wherein said parts of the sheet material are on both sides of the slits.

14. A pocket according to claim 12, wherein said parts of the sheet material are joined to each other by heat welding.

15. A pocket according to claim 12, wherein said parts of the sheet material are joined to each other by adhesive bonding.

16. A pocket according to claim 12, wherein said parts of the sheet material are joined to each other by sewing.

* * * * *